United States Patent [19]

Brackmann et al.

[11] 4,369,797

[45] Jan. 25, 1983

[54] FEED MECHANISM FOR TOBACCO CUTTING MACHINES

[75] Inventors: Warren A. Brackmann, Cooksville; Stanislav M. Snaidr, Mississauga, both of Canada

[73] Assignee: Rothmans of Pall Mall Canada Limited, Don Mills, Canada

[21] Appl. No.: 215,006

[22] Filed: Dec. 10, 1980

[30] Foreign Application Priority Data

Dec. 12, 1979 [GB] United Kingdom ..... 7942887

[51] Int. Cl.[3] ..... A24B 7/04; A24B 7/14

[52] U.S. Cl. ..... 131/109 AB; 131/117; 131/118; 198/771

[58] Field of Search ..... 131/109 R, 109 AB, 117, 131/118; 198/771

[56] References Cited

U.S. PATENT DOCUMENTS

| | | | |
|---|---|---|---|
| 2,897,956 | 8/1959 | Damond | 198/771 |
| 4,149,547 | 4/1979 | Komassa et al. | 131/109 AB |
| 4,244,382 | 1/1981 | Thiele et al. | 131/109 AB |
| 4,254,781 | 3/1981 | Thiele et al. | 131/109 AB |

*Primary Examiner*—Vincent Millin

*Attorney, Agent, or Firm*—Sim & McBurney

[57] ABSTRACT

Tobacco shreds of substantially less impaired filling power result from a tobacco lamina shredding machine when the lamina are formed into a tobacco layer in which the lamina are horizontally oriented and which is precompacted without the use of any force other than gravity and vibration and the tobacco layer is fed to the cutting operation without any substantial change in tobacco lamina orientation.

11 Claims, 4 Drawing Figures

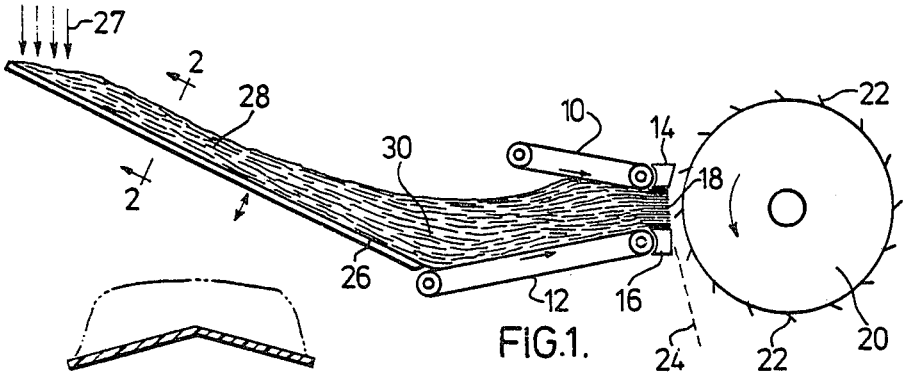
FIG.1.
FIG.2.
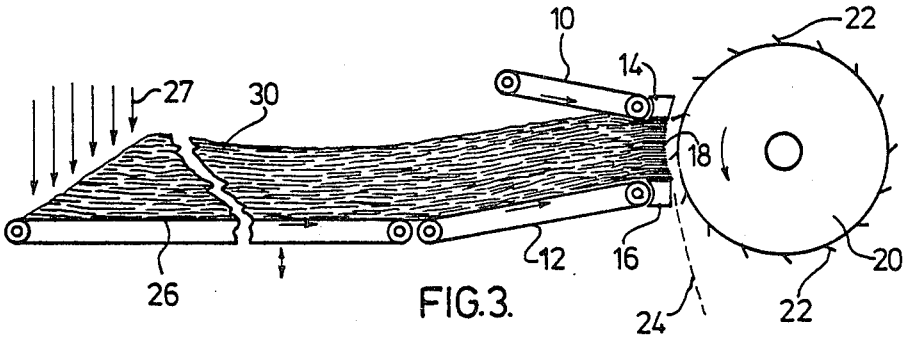
FIG.3.
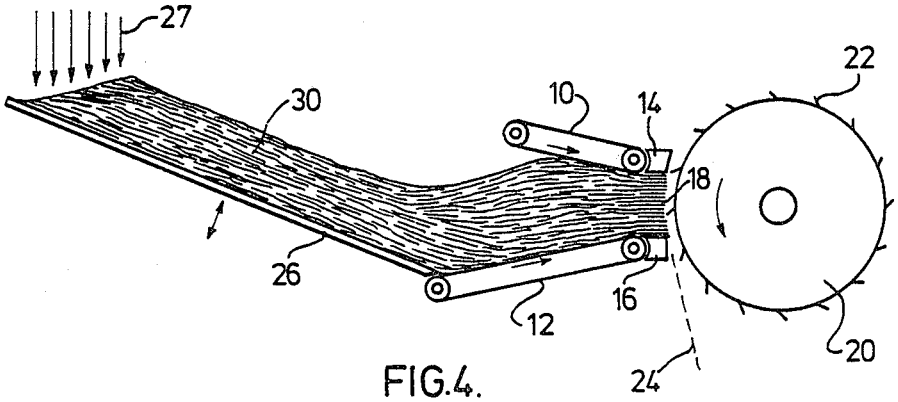
FIG.4.

FEED MECHANISM FOR TOBACCO CUTTING MACHINES

FIELD OF INVENTION

This invention is directed to tobacco cutting machines.

BACKGROUND TO THE INVENTION

A known type of tobacco shredding apparatus comprises a rotary carrier for one or more knives which cut tobacco shreds for use in making cigarettes from the leading face of a continuous cake of compacted tobacco. The cake is formed and its contents compacted by a feeding device comprising upper and lower feed conveyors which define a gradually narrowing path extending from a source of threshed tobacco lamina to a comminuting station where the leading face of the cake is squeezed between upper and lower pressure applying elements and moves into the range of the orbiting knives.

Conventionally an automatic feeding system is used to provide the source of tobacco leaves, comprising an upwardly-extending hopper into which the tobacco lamina are dumped. A reciprocally-movable end wall in the hopper opposite to the upstream throat of the conveyors is provided to assist in propelling the tobacco lamina into the throat. Such apparatus is shown in U.S. Pat. No. 4,090,521. The tobacco lamina are compressed somewhat by the gravitational force of the head of lamina in the hopper so as to increase the throughput of the shredding apparatus over what otherwise would be the case.

The latter procedure suffers from a number of drawbacks. The tobacco lamina enter the apparatus through a vertically-extending hopper and tend to assume a horizontal orientation. The rear wall movement required to move the lamina into the throat causes the tobacco to move towards a vertical orientation for movement between the compaction conveyors to the cutter. This effect results in the necessity to apply considerable pressure on the cake of tobacco at the cutter to prevent whole tobacco lamina from being pulled out uncut. The application of this pressure adversely affects the filling power of the tobacco.

The filling power of cut tobacco is its ability to fill a cigarette tube. The greater the filling power, the harder is the cigarette for the same quantity of tobacco. For the economic production of cigarettes, it is desirable for the filling power to be as high as possible. In the prior art procedure noted above, the tobacco tends not to be evenly distributed across the width of the compaction conveyors and, in particular, the tobacco at the sides tends to be less compact than in the middle. This phenomenon requires the exertion of even greater pressure on the tobacco cake at the cutters in excess of that required in the middle, so that tobacco lamina pull-out at the sides does not occur, thereby further adversely affecting the filling power of the tobacco.

The problem that is solved by the present invention is how to provide the same throughput to tobacco through the tobacco shredding apparatus while at the same time decreasing the pressure requirement at the cutter and thereby improving the filling power of the cut tobacco.

SUMMARY AND GENERAL DESCRIPTION OF INVENTION

In the present invention, the threshed lamina are formed into a generally horizontal layer in which the lamina are interleaved and each extends generally planarly of the layer, i.e., in a generally horizontal orientation and the layer is transported directly into the shredding apparatus without any significant change in orientation of the lamina in the layer.

In this way, substantially all the lamina enter the shredding apparatus in a horizontal orientation and substantially less pressure needs to be applied at the cutter to prevent lamina pull-out, so that the filling power of the tobacco shreds which are formed at the cutter is substantially less adversely affected than in the prior art.

In a preferred embodiment of the invention, the tobacco layer is compacted by the effect of gravitational and vibrational forces only, to increase the throughput of the shredder. By compacting the tobacco layer by the use of gravitational and vibrational forces only, much less compaction is required to be effected using the conveyors, as compared with the hopper-fed system of the prior art, for the same throughput of tobacco.

Since less compacting force needs to be applied to the tobacco lamina by the conveyors and such compacting force impairs the filling power of the cut tobacco, the gravity-induced precompaction which is effected in this invention further preserves the filling power of the cut tobacco. Another factor which is relevant to the filling power of the cut tobacco is the period of time over which physical force is applied to the tobacco, longer periods of time being more detrimental than shorter periods of time. The gravity-induced compacted tobacco is subjected to physical force for a lesser period of time than in the prior art, and this is a source of further filling power preservation.

In the prior art procedure noted above, the head of tobacco in the hopper applies physical force to the lamina in the lower part of the hopper and the tobacco which is forwarded to the cutter is subjected to compression between the conveyor all the way from the mouth to the cutter. Therefore, not only does the prior art procedure require the application of considerable pressure to the tobacco lamina at the cutter to prevent lamina pull-out as a result of disorientation of the lamina but also considerable physical force is applied to each tobacco lamina for a considerable period of time before it reaches the cutter. The filling power of the tobacco is considerably impaired by the pressure to which the tobacco is subjected.

The compaction of the tobacco by the use of gravitational and vibrational forces only may be brought about in this invention by depositing the tobacco lamina layer on a vibrating conveyor which subjects the lamina in the layer to vibrations which cause the lamina to settle and compact under their own weight and under the influence of gravity. Transportation of the lamina layer to the shredding apparatus may be achieved by utilizing a moving surface vibrating conveyor or by the utilization of gravitational forces by orienting the vibrating conveyor at an upwardly acute angle of no more than 45° to the horizontal, generally less than 30°.

The gravity-induced compaction and transportation may also be achieved by similarly upwardly angling the vibrating conveyor but, instead of forming a thick layer of tobacco lamina containing all the tobacco lamina to be then fed to the shredding apparatus, a thin layer of lamina is initially formed on the vibrating layer and the thick layer entering the shredding apparatus is formed by telescoping the lamina of the thin layer into lamina ahead of it in the vibrator as the lamina move down the conveyor.

The angle of the conveyor and the vibration rate applied to the tobacco in the latter procedure are controlled to prevent the formation of undulations in the layer, since such undulations tend to adversely affect the operation of the shredding apparatus, which requires a uniform thickness of tobacco at the cutter.

In order to overcome the problem of uneven distribution of lamina across the width of the tobacco in the cutter, in a particularly preferred embodiment of the invention the surface on which the tobacco layer is formed and transported to the shredding apparatus is arched transversely thereof.

While the present invention is described herein mainly with reference to threshed tobacco, the principles thereof are equally applicable to whole leaf tobacco.

BRIEF DESCRIPTION OF DRAWINGS

FIG. 1 is a schematic side elevational view of a tobacco cutting procedure provided in accordance with one embodiment of this invention;

FIG. 2 is a sectional view taken on line 2—2 of FIG. 1;

FIG. 3 is a schematic side elevational view of a tobacco cutting procedure in accordance with a second embodiment of the invention; and FIG. 4 is a schematic side elevational view of a tobacco cutting procedure in accordance with a third embodiment of the invention.

DESCRIPTION OF PREFERRED EMBODIMENTS

Referring first to FIGS. 1 and 2 of the drawings, upper and lower conveyors 10 and 12 converge towards a downstream throat at which is located a pair of upper and lower pressure plates 14 and 16 mounted to apply pressure to a tobacco cake 18 located therebetween. A rotating drum carrier 20 has a plurality of cutting knives 22 peripherally mounted for cutting shreds of tobacco 24 from the cake 18.

The tobacco shreds 24 usually are fed to a conditioning unit (not shown) which changes the moisture content and/or temperature of the shreds, prior to introduction of the conditioned shreds into the distributor of a cigarette making machine. In a typical plant operation, a plurality of such shredding apparatus is provided.

In accordance with this embodiment of the invention, a vibrating conveyor 26 is provided extending angularly upwardly with respect to the conveyor 10 and tobacco lamina are deposited thereon from a tobacco shower 27 in a thin layer 28 evenly distributed across the conveyor 26 and in which the lamina lie substantially horizontally. The vibrating conveyor 26 precompacts the lamina in the thin layer and, with the assistance of gravity, feeds the tobacco lamina down the slope of the conveyor 26 towards the upstream throat between the conveyors 10 and 12. The angle of the conveyor 26 to the horizontal is selected so that the tobacco lamina in the layer 28 interweave with forwardly-adjacent lamina to build up a thick compacted layer 30 at the upstream throat between the conveyors 10 and 12. The thick layer 30 contains the quantity of lamina desired to pass through the shredding unit and, as a result of the precompaction and interleaving, is of a thickness less than the vertical height of the throat so that the upper surface of the layer 30 engages the upper conveyor 10 part-way into the throat.

The use of a vibrating conveyor 26 arranged at a gentle angle, typically about 20° to 30°, to the conveyor 10 results in the tobacco lamina being oriented horizontally and interwoven one with another to achieve precompaction without the use of external force prior to compaction between the conveyors 10 and 12. It is preferred (as seen in FIG. 2) for the vibrating conveyor 26 to be arched along the length thereof in order to compensate for the tendency noted above for uneven distribution of tobacco across the width of the compacting conveyors 10 and 12.

Since the tobacco lamina in the tobacco layer 30 are oriented horizontally, are precompacted and are interleaved, much less pressure needs to be applied by the elements 14 and 16 to prevent leaf pull-out from the tobacco cake 18 than is the case of the prior art system wherein a hopper feed is used for the same throughput of tobacco.

In addition, the use of the arched conveyor surface on the vibrating conveyor 26 provides a more even distribution of tobacco across the width of the tobacco cake 18 than is the case of the prior art and this contributes further to the decreased pressure requirement. It has been found that the pressure requirement can be decreased to less than half that conventionally used with the prior art hopper-feed apparatus.

Turning now to FIG. 3, there is illustrated therein a second embodiment of the invention, wherein the thick layer 30 is formed directly on the vibrating conveyor 26 from a shower of lamina 27 by positioning the lamina in horizontal orientation on the conveyor 26 in substantially uniform distribution across the width thereof.

In this instance, the conveyor 26 is positioned horizontally and is of the type which imparts longitudinal movement to the layer 30 to feed the same to the upstream throat between the conveyors 10 and 12. Precompaction of the lamina in the layer 30 without the use of force is achieved by vibration.

In the embodiment of FIG. 2, therefore, the thick layer 30 is formed directly on the conveyor 26 instead of being formed by interleaving of lamina from an initial thin layer 28, as in the embodiment of FIG. 1. The thick layer 30 is precompacted by vibration.

FIG. 4 illustrates a variation of the embodiment of FIG. 3 wherein the vibrating conveyor 26 is positioned at an upward angle to the horizontal, so that movement of the thick layer 30 to the upstream throat between the conveyors 10 and 12 is achieved by gravity. Precompaction of the thick layer 30 occurs as a result of vibrations of the conveyor 26.

The ability to operate with less compression of the tobacco in the tobacco cake 18 at the cutter 20 and the application of compression forces by the conveyors 10 and 12 for a shorter period of time as a result of precompaction and proper lamina orientation in accordance with this invention result in a much decreased impairment of the power of the tobacco shreds 24 when subsequently used in cigarette manufacture, leading to greater economy of tobacco use, as compared with prior art procedures.

A more consistent width of cut of tobacco from piece to piece is attained using the procedure of this invention, so that the quality of the tobacco shreds produced is improved with respect to those produced by the prior art procedure.

In addition, the infeed flow rate may be varied, in which event the physical height of the tobacco cake 18 varies. This throughput variation depends only on the flow input to the cutter, rather than by the use of compression as in the prior art. A very short start up period is required with the procedure of this invention.

SUMMARY OF DISCLOSURE

In summary of this disclosure, the present invention provides a novel method of feeding tobacco lamina to a tobacco cutting machine to result in improved filling power of the tobacco shreds, when compared with the prior art. Modifications are possible within the scope of the invention.

What we claim is:

1. A method of supplying tobacco in threshed tobacco lamina or whole leaf form to a cutting station wherein the tobacco is forwarded horizontally and is comminuted at the rate at which it enters the station, which comprises:

forming a relatively thin layer of tobacco on a conveying surface in which the tobacco is oriented substantially planarly of the layer and is substantially evenly distributed across the width thereof, subjecting said thin layer to vibration whereby the tobacco in said layer densifies without the use of any force other than gravity, conveying said thin layer towards said cutting station, inlerleaving said tobacco in said thin layer with longitudinally-adjacent tobacco without altering the orientation of the leaves in the said thin layer to form a relatively thick layer of interwoven compacted tobacco in which the tobacco is oriented planarly of the relatively-thick layer and containing the quantity of tobacco desired to be fed to said cutting station, and feeding said relatively thick layer to said cutting station without substantially altering the orientation of the tobacco in said layer.

2. The method of claim 1 wherein said conveying surface is inclined whereby said conveying is achieved by gravitational forces.

3. The method of claim 1 or 2 wherein the speed and force of conveying of said thin layer is maintained less than that which causes mounds of tobacco to form.

4. A method of supplying tobacco in threshed tobacco lamina or whole leaf form to a cutting station wherein the tobacco is forwarded horizontally and is comminuted at the rate at which it enters the station, which comprises:

forming a relatively thick layer of tobacco containing the quantity of tobacco desired to be fed to the cutting station on a generally horizontally-extending conveying surface directly from a shower of tobacco in the whole leaf or threshed lamina form and in which the tobacco is oriented substantially planarly of the layer and is substantially evenly distributed across the width of the layer, subjecting said thick layer to vibration whereby the tobacco in said layer densifies without the use of any force other than gravity while simultaneously conveying said thick layer on said conveying surface towards said cutting station without substantially altering the orientation and juxtaposition of said tobacco in said layer, and conveying the densified layer to said cutting station without substantially altering the orientation and juxtaposition of the tobacco in said densified layer.

5. The method of claim 4 wherein said conveying surface extends substantially horizontally and moves towards said cutting station to achieve said conveying of said thick layer while said thick layer is subjected to said vibration.

6. The method of claim 4 wherein said conveying surface extends at a gentle upwardly inclined angle and said conveying of said thick layer while said thick layer is subjected to said vibration is achieved by gravitational forces.

7. In a method of forming cut tobacco shreds by compacting tobacco in whole leaf or threshed lamina form between converging upper and lower conveyors, gripping the tobacco cake so formed at the downstream end of said conveyors, and cutting tobacco shreds from the cake, the improvement which comprises:

forming a relatively thick layer of tobacco wherein the tobacco is oriented substantially planarly of the layer, the tobacco is interleaved and the tobacco is substantially uniformly distributed across the layer, said tobacco layer containing the quantity of tobacco desired to be fed to the cutting station and being formed directly from a shower of tobacco, densifying the tobacco layer by applying gravitational and vibrational forces only thereto while simultaneously conveying said tobacco towards the upstream end of said conveyors without substantially altering the orientation and juxtaposition of the tobacco in said layer, and feeding the densified layer to the upstream end of said conveyor without substantially altering the orientation and juxtaposition of the tobacco in said densified layer.

8. The method of claim 7 wherein the upper one of said converging conveyors engages the upper surface of the densified tobacco layer only after the densified layer has been passed part of the way towards the downstream end.

9. In an apparatus for forming cut tobacco which comprises upper and lower tobacco conveyors converging towards a downstream end, pressure applying means at said downstream end for applying pressure to tobacco thereat, cutting means located adjacent said pressure applying means for cutting tobacco held by said pressure applying means, and conveying means for conveying tobacco to said upstream end of said conveyors, the improvement wherein said conveying means comprises a generally horizontally-extending vibrating conveyor having an upper longitudinal tobacco-conveying surface having an axially-extending central portion which is higher than the axially-extending edge portions thereof.

10. The apparatus of claim 9 wherein said vibrating conveyor is oriented angularly upwardly from said upstream end of said conveyors.

11. The apparatus of claim 9 wherein said vibrating conveyor extends substantially horizontally and said tobacco conveying surface is capable of rectilinear motion.

* * * * *

REEXAMINATION CERTIFICATE (726th)

United States Patent [19]

Brackmann et al.

[11] B1 4,369,797

[45] Certificate Issued Jul. 14, 1987

[54] FEED MECHANISM FOR TOBACCO CUTTING MACHINES

[75] Inventors: Warren A. Brackmann, Cooksville; Stanislav M. Snaidr, Mississauga, both of Canada

[73] Assignee: Rothmans of Pall Mall Canada Limited, Don Mills, Canada

Reexamination Request:
No. 90/000,433, Aug. 12, 1983

Reexamination Certificate for:

| | |
|---|---|
| Patent No.: | **4,369,797** |
| Issued: | **Jan. 25, 1983** |
| Appl. No.: | **215,006** |
| Filed: | **Dec. 10, 1980** |

[30] Foreign Application Priority Data

Dec. 12, 1979 [GB] United Kingdom ..... 7942887

[51] Int. Cl.[4] ..... A24B 7/04

[52] U.S. Cl. ..... 131/109.3; 131/117; 131/118; 198/771

[58] Field of Search ..... 131/109.3, 109.1, 117, 131/118, 109.2; 198/771

[56] References Cited

U.S. PATENT DOCUMENTS

| | | | |
|---|---|---|---|
| 2,275,103 | 3/1942 | Gooch et al. | 131/81 |
| 2,535,692 | 12/1950 | Molins et al. | 100/94 |
| 3,185,196 | 5/1965 | Ward | 241/101.4 |
| 4,090,521 | 5/1979 | Elsner | 131/109 R |
| 4,149,547 | 4/1979 | Komossa | 131/109 AB |
| 4,244,382 | 1/1981 | Thiele et al. | 131/109 AB |
| 4,254,781 | 3/1981 | Thiele et al. | 131/111 |

FOREIGN PATENT DOCUMENTS

| | | | |
|---|---|---|---|
| 0165983 | 5/1950 | Austria | 131/111 |
| 1281908 | of 0000 | Fed. Rep. of Germany . | |
| 2903563 | 10/1979 | Fed. Rep. of Germany . | |
| 2924410 | 12/1980 | Fed. Rep. of Germany . | |
| 2424713 | 11/1979 | France . | |
| 84000 | 12/1976 | Japan . | |
| 21400 | 12/1977 | Japan . | |
| 134099 | 12/1977 | Japan . | |
| 132299 | 12/1979 | Japan . | |
| 0232229 | 7/1925 | United Kingdom . | |
| 0377854 | 8/1932 | United Kingdom . | |
| 0396607 | 8/1933 | United Kingdom . | |
| 0455098 | 10/1936 | United Kingdom . | |
| 0455119 | 10/1936 | United Kingdom . | |
| 0980935 | 1/1965 | United Kingdom . | |

*Primary Examiner*—Vincent Millin

[57] ABSTRACT

Tobacco shreds of substantially less impaired filling power result from a tobacco lamina shredding machine when the lamina are formed into a tobacco layer in which the lamina are horizontally oriented and which is precompacted without the use of any force other than gravity and vibration and the tobacco layer is fed to the cutting operation without any substantial change in tobacco lamina orientation.

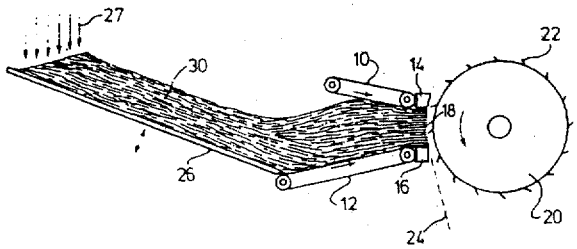

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2, 4–7 and 11 are determined to be patentable as amended.

Claims 3 and 8–10, dependent on an amended claim, are determined to be patentable.

New claims 12–23 are added and determined to be patentable.

1. A method of supplying tobacco is threshed tobacco lamina or whole leaf form to a cutting station *in which cutting station* [wherein] the tobacco is forwarded *substantially* horizontally *from an upstream end thereof* and is comminuted *at a downstream end thereof* at the rate at which *the tobacco* [it] enters the station, which comprises:

forming a relatively thin layer of tobacco on [a] *an elongate* conveying surface *at a location remote from said cutting station,* [in which] the tobacco *in said layer being* [is] oriented substantially planarly of the layer and [is] substantially evenly distributed across the width thereof, subjecting said thin layer *on said conveying surface* to vibration whereby the tobacco in said layer densifies without the use of any force other than gravity *while simultaneously*[,] conveying said thin layer *on said conveying surface* towards said cutting station *without substantially altering the orientation and juxtaposition of said tobacco in said layer,* interleaving said tobacco in said thin layer with longitudinally-adjacent tabacco *substantially* without altering the orientation of the leaves in the said thin layer to form a relatively thick layer of interwoven compacted tobacco in which the tobacco is oriented planarly of the relatively-thick layer and containing the quantity of tobacco desired to be fed to said cutting station, and feeding said relatively thick layer to said cutting station without substantially altering the orientation of the tobacco in said layer.

2. The method of claim 1 wherein said conveying surface is inclined *upwardly from said upstream end of said cutting station* whereby said conveying is achieved by gravitational forces.

4. A method of supplying tobacco in threshed tobacco lamina or whole leaf form to a cutting station *in which cutting station* [wherein] the tobacco is forwarded *substantially* horizontally *from an upstream end thereof* and is comminuted *at a downstream end thereof* at the rate at which it enters the station, which comprises:

forming a relatively thick layer of tobacco containing the quantity of tobacco desired to be fed to the cutting station on a generally horizontally-extending *elongate* conveying surface directly from a shower of tobacco in the whole leaf or threshed lamina form and in which the tobacco is oriented substantially planarly of the layer and is substantially evenly distributed across the width of the layer, subjecting said thick layer to vibration whereby the tobacco in said layer densifies without the use of any force other than gravity while simultaneously conveying said thick layer on said conveying surface towards said cutting station without substantially altering the orientation and juxtaposition of said tobacco in said layer, and conveying the densified layer *through* [to] said cutting station without substantially altering the orientation and juxtaposition of the tobacco in said densified layer.

5. The method of claim 4 wherein said conveying surface extends substantially horizontally *from said upstream end of said cutting station* and moves *unidirectionally* towards said cutting station to achieve said conveying of said thick layer while said thick layer is subjected to said vibration.

6. The method of claim 4 wherein said conveying surface extends *upwardly from said upstream end of said cutting station* at a gentle upwardly inclined angle and said conveying of said thick layer while said thick layer is subjected to said vibration is achieved by gravitational forces.

7. In a method of forming cut tobacco shreds by compacting tobacco in whole leaf or threshed lamina form between converging upper and lower conveyors *having an upstream end and a downstream end,* gripping the tobacco cake so formed at the downstream end of said conveyors, and cutting tobacco shreds from the cake, the improvement which comprises:

forming a relatively thick layer of tobacco wherein the tobacco is oriented substantially planarly of the layer, the tobacco is interleaved and the tobacco is substantially uniformly distributed across the layer, said tobacco layer containing the quantity of tobacco desired to be fed to the cutting station and being formed directly from a shower of *tobacco* [tobacoo], densifying the tobacco layer by applying gravitational and vibrational forces only thereto while simultaneously conveying said tobacco towards the upstream end of said *converging* conveyors without substantially altering the orientation and juxtaposition of the tobacco in said layer, and feeding the densified layer to the upstream end of said *converging* [conveyor] *conveyors* without substantially altering the orientation and juxtaposition of the tobacco in said densified layer.

11. The apparatus of claim 9 wherein said vibrating conveyor extends substantially horizontally and said tobacco conveying surface is capable of *unidirectional* rectilinear motion.

*12. The method of claim 2 wherein said conveying surface is inclined upwardly at an angle of about 20° to 30° to the horizontal.*

*13. The method of claim 6 wherein said conveying surface extends upwardly at an angle of about 20° to 30° to the horizontal.*

*14. The method of claim 7 wherein said relatively thick layer is formed on an elongate substantially horizontal vibrating conveying surface extending from the upstream*

*end of said converging conveyors at a location thereon remote from said converging conveyors, said densifying step is effected by vibrations of said conveying surface which include a vertical component of vibration, and said conveying and feeding steps are effected by unidirectional rectilinear motion of said conveying surface from said remote location to said upstream end of said converging conveyors.*

*15. The method of claim 14 wherein said relatively thick layer is formed on said conveying surface by raining said shower of said tobacco in whole leaf or theshed lamina form onto said conveying surface at said remote location over a longitudinal length of said conveying surface.*

*16. The method of claim 1 wherein said vibration includes a component of vibration generally normal to the plane of said thin layer.*

*17. The method of claim 4 wherein said vibration includes a component of vibration generally normal to the plane of said relatively thick layer.*

*18. The method of claim 6 wherein said vibration includes a component of vibration generally normal to the plane of said relatively thick layer.*

*19. A method of supplying tobacco in threshed tobacco lamina or whole leaf form to a cutting station in which cutting station the tobacco is forwarded substantially horizontally and is comminuted at the rate at which the tobacco enters the station, which comprises:*

*forming a tobacco layer at a location remote from said cutting station and transporting said tobacco layer from said location to said cutting station, and*

*densifying the tobacco in the layer by vibration during said transportation of said tobacco layer from said remote location to said cutting station without substantially altering the orientation and juxtaposition of the tobacco in the layer.*

*20. The method of claim 19 wherein said tobacco layer is formed at said remote location directly from a falling shower of tobacco.*

*21. The method of claim 20 wherein said densification of said tobacco layer is effected by vibrations which include a component of vibration normal to the plane of the tobacco layer.*

*22. The method of claim 21 wherein said layer is formed on a substantially horizontal conveying surface which extends from said remote location to said cutting station and which moves unidirectionally longitudinally towards said cutting station to effect said transportation of said tobacco layer thereon.*

*23. The method of claim 22 wherein said remote location is situated with respect to said cutting station such that said tobacco layer achieves its maximum density attainable by vibration prior to reaching said cutting station.*

* * * * *